US005108039A

United States Patent [19]

Schnell

[11] Patent Number: 5,108,039

[45] Date of Patent: Apr. 28, 1992

[54] COMMINUTING MACHINE

[75] Inventor: Karl Schnell, Winterbach, Fed. Rep. of Germany

[73] Assignee: Karl Schnell GmbH & Co. Maschinenfabrik, Winterbach, Fed. Rep. of Germany

[21] Appl. No.: 544,185

[22] Filed: Jun. 26, 1990

[30] Foreign Application Priority Data

Jun. 28, 1989 [DE] Fed. Rep. of Germany ..... 3921109

[51] Int. Cl.[5] ..... B02C 18/30

[52] U.S. Cl. ..... 241/34; 241/62; 241/81; 241/82.5; 415/169.1

[58] Field of Search ..... 241/81, 82.1, 82.5, 241/152 R, 34, 62; 415/143, 169.1, 121.1

[56] References Cited

U.S. PATENT DOCUMENTS

| | | | |
|---|---|---|---|
| 3,973,866 | 8/1976 | Vaughan | 415/121.1 |
| 4,402,648 | 9/1983 | Kretschmer | 415/121.1 |
| 4,422,372 | 12/1983 | Hoezee | 241/82.5 X |
| 4,479,614 | 10/1984 | Bernard | 241/82.5 X |
| 4,637,779 | 1/1987 | Sherman et al. | 415/143 |
| 4,700,899 | 10/1987 | Powers et al. | 241/82.5 X |
| 4,706,818 | 11/1987 | Zutell et al. | 241/81 X |
| 4,775,108 | 10/1988 | Schnell | 241/82.5 X |
| 4,896,836 | 1/1990 | Mitchell | 241/81 |

*Primary Examiner*—Mark Rosenbaum
*Assistant Examiner*—Frances Chin
*Attorney, Agent, or Firm*—Toren, McGeady & Associates

[57] ABSTRACT

A comminuting machine for comminuting meat and the like and especially for material which has been previously cut into small pieces. The comminuting machine includes at least one cutting unit. A feed pump is arranged in front of the inlet of the comminuting machine and a vacuum suction device is connected to the interior of the feed pump. A separating device for solid objects, especially a separating device for ferromagnetic objects including at least one electromagnet, is mounted between the feed pump and the comminuting machine.

3 Claims, 3 Drawing Sheets

COMMINUTING MACHINE

BACKGROUND OF THE INVENTION

1. Field of the Invention

The present invention relates to a comminuting machine for finely comminuting especially meats, sausage meat and the like, wherein the comminuting machine includes at least one cutting unit.

2. Description of the Related Art

Various types of such comminuting machines have been used for many years. They are used primarily in the food industry and particularly in the meat-processing industry. The material to be comminuted is usually fed to the comminuting machine by filling it into a hopper and gravity then causes the material to be fed into the feeding duct of the comminuting machine. When the material to be comminuted is coarse, there is the danger that air is admitted to the interior. The air bubbles usually cannot escape from the material to be comminuted and, thus, inevitably travel together with the material to be comminuted through the comminuting machine. As a rule, a filling machine is arranged following the comminuting machine and, therefore, when the material is fed to the filling machine, the air can still not escape. Consequently, the air reaches the packaging unit, for example, a sausage.

Since the air content can vary significantly, portions of different weight are obtained when the comminuted material is divided into portions. This is objectionable at least to the consumer.

SUMMARY OF THE INVENTION

It is, therefore, the object of the invention to further develop a comminuting machine of the above-described type, so that the admitting of air to the material to be comminuted is excluded, or at least essentially avoided.

In accordance with the present invention, a feed pump is arranged in front of the inlet of the comminuting machine and a vacuum suction device is connected to the interior of the feed pump.

The comminuting machine according to the present invention provides two essential features, namely, the supply of the material to be comminuted to the comminuting machine under pressure and the evacuation of the material before it enters the feed pump.

The operating result obtained with the comminuting machine according to the invention is determined by the degree of evacuation. When a powerful vacuum suction device is used, and when especially the suction ducts of the vacuum suction device is arranged at an optimum location, the material to be comminuted can be rendered completely free or essentially free of air before it enters the pump, so that the comminuted material is discharged from the comminuting machine essentially without air. In foodstuffs, particularly sausage meats and the like, the comminuting machine provides another advantage in that, because of the absence of air and, thus, the absence of oxygen, the material filled into portioned packages, particularly the sausage meat filled into a sausageskin, is no longer subject to spoilage, or is at least not as much subject to spoilage as in the past, and, therefore, the product stays fresh longer.

Hooks are used many times in the meat-processing industry. Unfortunately, it cannot be entirely excluded that not only meats or sausage meat reaches the feeding hopper or the like but also hooks or parts thereof. Aside from hygienic problems and a possible danger of injury when the sausage or the like is eaten, these hooks or other solid objects represent a significant danger for the machine itself, particularly for the cutting unit thereof.

In order to improve the comminuting machine in this respect, and primarily in order to avoid spoilage of the comminuted material due to such foreign bodies, a further development of the present invention provides that a separating device for solid objects, particularly metal objects, is arranged between the outlet of the feed pump and the inlet of the comminuting machine. This separating device, and particularly the arrangement of the separating device in the comminuting machine, not only ensures that the objects are separated, but also ensures that the sensitive cutting unit of the comminuting machine is protected.

Since in the preferred field of use of the comminuting machine especially metal hooks and the like are used, it is particularly advantageous if a metal separating device has at least one magnet, particularly an electromagnet. The electromagnet can recognize and attract all ferromagnetic objects. Of course, the force of the magnet or magnets and the rate of travel of the material and the cross-sectional area at the respective locations play important roles. Thus, when part of an iron hook or the like is detected, it is possible without problems not only to have the magnet hold the part of the hook, but also to generate an appropriate signal. This signal makes it possible for the user of the comminuting machine to stop the machine and, when the separating device is appropriately constructed, to remove the part of the hook or the like and subsequently to restart the machine.

In accordance with a preferred embodiment of the invention, the metal detecting device has a housing which automatically opens when a ferromagnetic material is present. Modern control technology makes it possible for the user to switch off the pump drive when the housing is opened, so that the entire material being comminuted is not discharged through the housing opening of the metal detecting device. It is also conceivable that the housing cover or the like is immediately closed after the metal which has been held is eliminated. When the part of the hook or the like is removed automatically, the magnets must be switched off when the housing is open, so that the part of the hook can be released from the magnet.

The comminuting machine has two cutting units of known construction which are arranged one behind the other. Each cutting unit has a perforated disk and a driven knife. The machine is primarily a fine comminuting machine or even a very fine comminuting machine from which the material is discharged in the form of a paste-like substance. An emulsifier can be easily arranged following the comminuting machine. Also, when sausage is being manufactured, not only the material to be comminuted but all additives for the sausage can be fed directly to the comminuting machine.

In accordance with another development of the invention, a centrifugal device forming a separating device is arranged in front of the first cutting unit. The centrifugal device is composed of a driven centrifugal disk and a collecting housing surrounding the centrifugal disk. The centrifugal disk may be mounted on the knife shaft, so that it does not require a separate drive.

Comminuting machines of this type are usually openable because they must be thoroughly cleaned after use for hygienic reasons. As a consequence, the housing of the separating device which may be integrated in the housing of the cutting machine is also opened. All objects collected in the machine are then removed. Although a comminuting machine of this type is provided with a magnetically operating separating device, the additional separating device which operates on the basis of centrifugal force is also justified because a magnet can only separate ferromagnetic tools, but not hooks of aluminum which are also frequently used.

In accordance with another feature of the invention, the feed pump includes a pinion with external toothing which is rotatable in a pump housing and a wheel with internal toothing arranged eccentrically relative to the pinion, and a particularly two-piece sickle-shaped intermediate piece, wherein an inner opening of the vacuum suction device is arranged at the inlet side of the pump. Such pumps with vacuum suction have already been used in the meat-processing industry, however, they have in the past not been used as feed pumps for supplying the material to be comminuted to a comminuting machine with cutting units. In order to obtain a relatively powerful comminuting machine, the comminuting machine according to the present invention includes a particularly powerful pump, particularly a pump with a high throughput and, thus, a pump of appropriate size.

In addition, it is very advantageous if a front side of the gear wheel is provided with a cover of the pump housing which can be swung laterally in its plane. The cover of the pump housing supports a feeding hopper or the like and the vacuum suction device, particularly a vacuum pump. The feeding hopper in connection with pumps of this type is also already known in the meat-processing field and also known is the lateral swinging-out of the housing member constructed as cover. This makes it possible to quickly and thoroughly clean the pump. However, in the past, the vacuum suction was connected to the point of the pump housing which could not be swung out. By mounting it on the cover, it is advantageously ensured that, when cleaning is carried out, particularly by means of a strong water jet, residues of the comminuted material can reach the suction ducts of the vacuum suction device.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
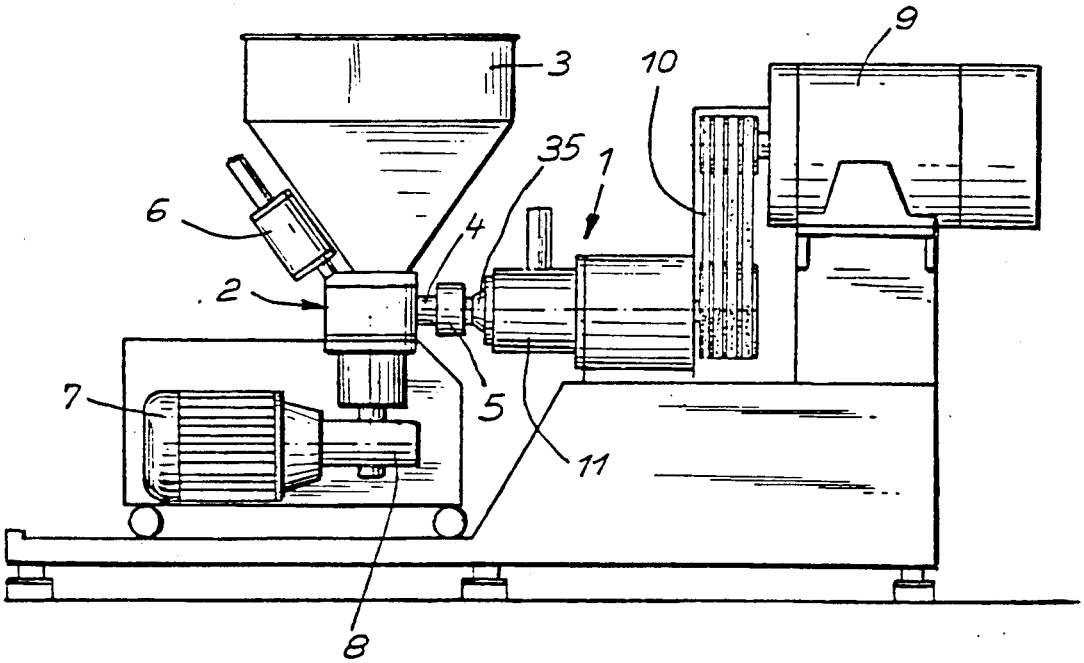
FIG. 1 is a schematic side view of the comminuting machine according to the present invention.

FIG. 1 of the drawing shows the comminuting machine 1 including a feed pump 2 with a feeding hopper 3. The material to be comminuted is filled in a suitable and known manner into the feeding hopper 3. In the illustrated embodiment, the feed pump 2 is connected to the comminuting machine 1 through a tubular, non-metal line 4. A separating device 5 for solid objects, particularly ferromagnetic objects, is mounted in the line 4. The interior of the pump can be evacuated by means of a vacuum suction device 6. The vacuum suction device 6 serves to remove air admixtures of the material to be comminuted which reached the pump together with the material through the feeding hopper 3.

The pump 2 is driven by means of an electric motor 7, preferably with the intermediate arrangement of a gear unit 8. Another electric motor 9 drives the rotatable elements of the comminuting machine 1. A belt drive 10 or another suitable gear system can be arranged between the electric motor 9 and the comminuting machine 1.

The separating device 5 is capable of removing ferromagnetic objects, particularly parts of iron meat hooks and other metals. The device 5 has an openable housing and in its interior at least one magnet, preferably an electromagnet. Another separating device operating on the principle of centrifugal force may be integrated in the housing 11 of the comminuting machine 1.

Figure 2:
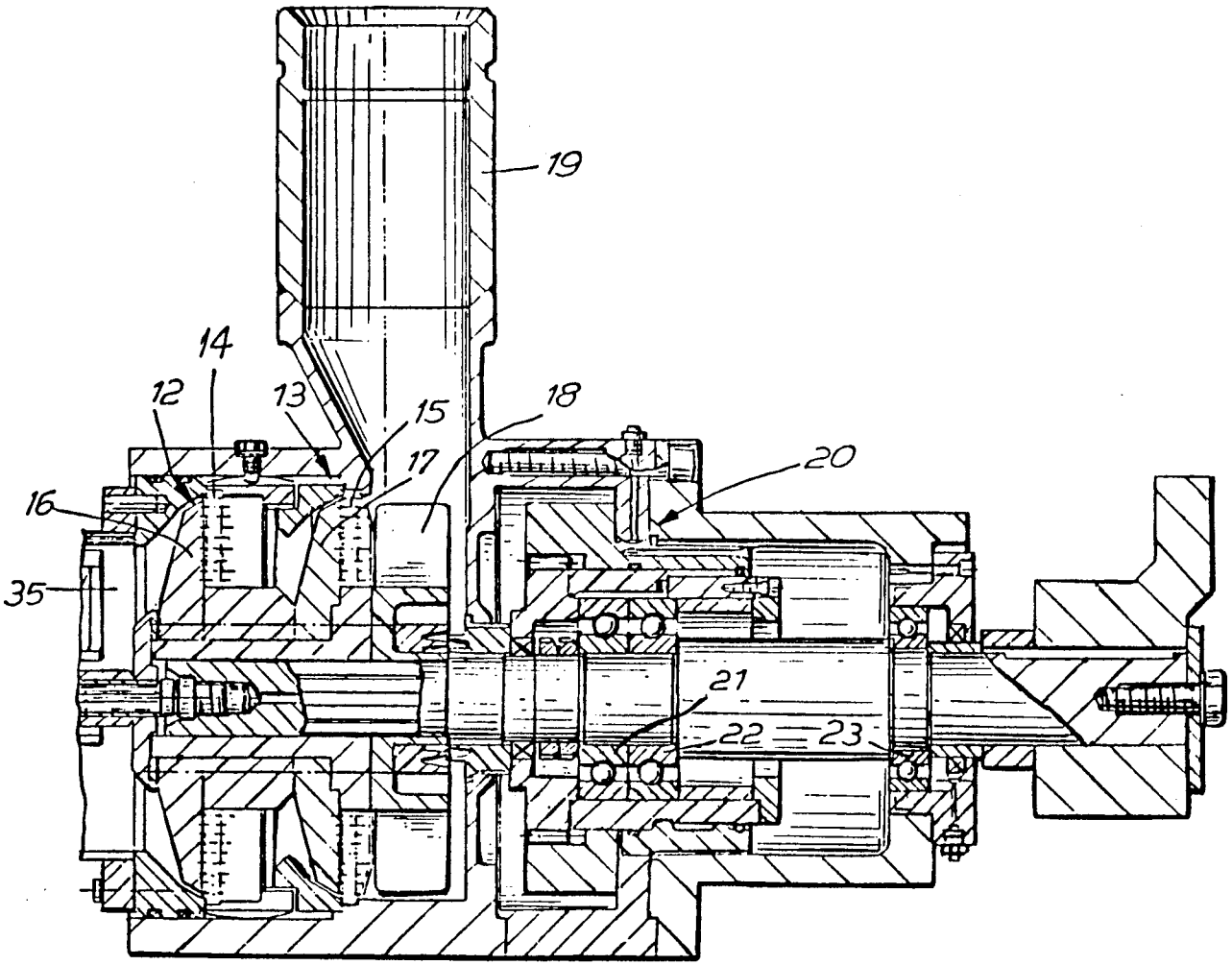
FIG. 2 is a partial sectional view, on a larger scale, of the comminuting machine.

As shown in FIG. 2, the comminuting machine 1 has two conventional cutting units 12 and 13 which are arranged one behind the other. Each cutting unit includes a perforated plate 14 or 15 and a cutting knife 16 or 17 which cooperates with the perforated plate 14 or 15. The cutting knives 16, 17 are driven by motor 9. Also mounted on the drive shaft is an ejector wing 18 which helps to prevent clogging at the outlet side. The finely comminuted material leaves the comminuting machine through the outlet pipe 19. The latter can be connected to a sausage filling machine, portioning machine or the like.

FIG. 2 of the drawing also shows an adjusting device 20 for the knife shaft. The knife shaft bearings are denoted by reference numerals 21 through 23.

Figure 4:
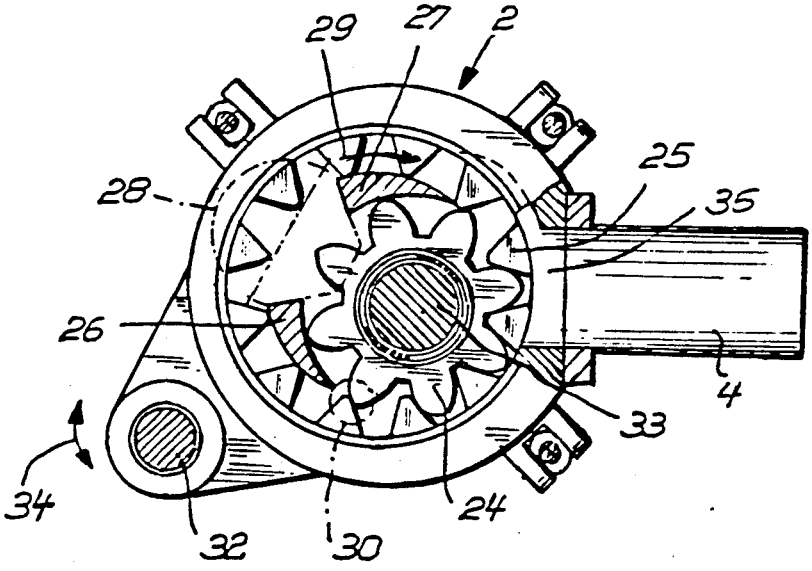
FIG. 4 is a top view of the opened pump.

FIG. 4 of the drawing shows the very powerful feed pump 2 which is known in principle. Important elements are a driven pinion 24, an outer wheel 25 with inner toothing arranged concentrically to the pinion 24, and a two-piece, sickle-shaped intermediate member 26, 27 which is inserted into a sickle-shaped gap between the toothings.

Figure 3:
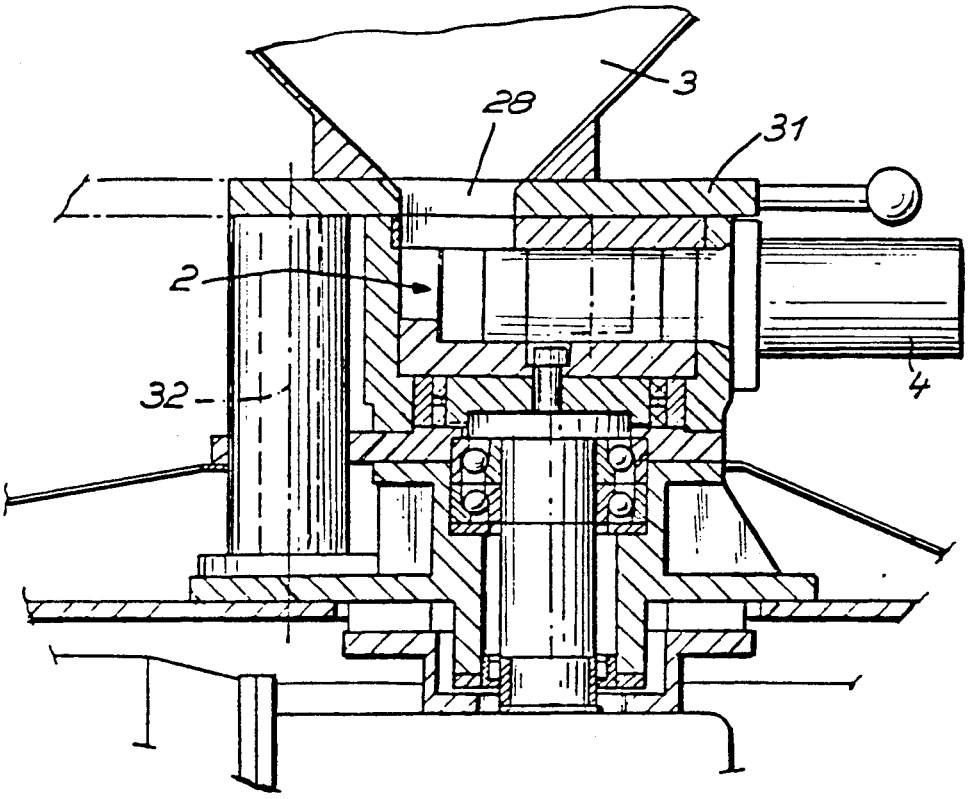
FIG. 3 is a partial vertical sectional view of the pump with feeding hopper of the comminuting machine.

The outlet of the feeding hopper 3 and, thus, the inlet 28 of the feed pump 2 is shown in section in FIG. 3 and is illustrated in FIG. 4 with a dash-dot line 28. The inlet 28 is located between the two parts 26 and 27 of the sickle-shaped intermediate member and approximately at the location where the radial distance between the toothings of pinion and outer wheel is the greatest.

The inner opening 30 of the vacuum suction device 6 is arranged in front of the inlet 28 seen in the direction of rotation 29 of the pump wheel. The opening 30 is located approximately at the tip of the intermediate piece 26.

The cover 31 of the pump housing can be swung in the direction of double arrow 34 about an axis 32 which extends parallel to the drive axis 33 of the pump pinion 24, so that the interior of the pump is easily accessible for cleaning purposes. Since the feeding hopper 3 and the vacuum suction device 6 are mounted on the cover 31, these elements are also swung out when the pump is opened.

Finally, it should be mentioned that the inlet of the comminuting machine 1 is denoted by the reference numeral 35 in FIG. 1. The outlet of the feed pump 2 is denoted by reference numeral 36.

While a specific embodiment of the invention has been shown and described in detail to illustrate the application of the inventive principles, it will be understood that the invention may be embodied otherwise without departing from such principles.

I claim:

1. A comminuting machine for finely comminuting meats, the comminuting machine comprising an inlet for filling in precomminuted meat and at least one cutting unit, a feed pump connected to the inlet of the comminuting machine, the feed pump having an outlet and an interior, a vacuum suction device being connected to the interior of the feed pump upstream of the inlet of the feed pump, a separating device for metal objects mounted between the outlet of the feed pump for the precomminuted meat and the inlet of the comminuting machine, wherein the separating device for metal objects includes at least one electromagnet, wherein the separating device for metal objects further includes an openable housing, and the comminuting machine further comprising means for automatically opening the housing when a ferromagnetic material is present in the housing and means for switching off the pump when the housing is opened, the feed pump including a pump housing, a rotatable pinion with external toothing and a wheel with internal toothing arranged eccentrically relative to the pinion being mounted in the pump housing, a two-part sickle-shaped intermediate piece being mounted between the pinion and the wheel, the vacuum suction device having an inner opening and the feed pump having an inlet side, wherein the inner opening is in communication with the inlet side of the feed pump.

2. The comminuting machine according to claim 1, wherein the feed pump has a housing, the pinion and the wheel having end faces, the pump housing having a cover which is laterally pivotable in its plane at the end faces of the pinion and the wheel, a feeding hopper and the vacuum suction device being mounted on the cover.

3. The comminuting machine according to claim 2, wherein the vacuum suction device is a vacuum pump.

* * * * *